US006712622B1

(12) United States Patent
Self et al.

(10) Patent No.: US 6,712,622 B1
(45) Date of Patent: Mar. 30, 2004

(54) CONNECTOR TERMINATION ADAPTER

(75) Inventors: Bob J. Self, Colorado Springs, CO (US); Robert H. Wardwell, Colorado Springs, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/256,343

(22) Filed: Sep. 27, 2002

(51) Int. Cl.[7] ..... H01R 13/00
(52) U.S. Cl. ..... 439/65; 439/66; 439/638
(58) Field of Search ..... 439/66, 482, 638, 439/289, 71, 912, 219; 329/158 F, 158 P, 760, 759, 539, 538; 361/760

(56) References Cited

U.S. PATENT DOCUMENTS 4,790,894 A * 12/1988 Homma et al. ..... 156/250
6,447,339 B1 * 9/2002 Reed et al. ..... 439/638

* cited by examiner

*Primary Examiner*—Alexander Gilman

(57) ABSTRACT

An adapter for attaching a connector having a plurality of pads to a device under test. The adapter is comprised of two types of parts a carrier cradle and at least one circuit substrate. The circuit substrate has plurality of pads formed on a first and second edge. A plurality of circuits are formed on a first side of the circuit substrate, each circuit connecting a pad on the first edge of the circuit substrate to a pad on the second edge of the circuit substrate. The circuit substrate is supported by the carrier cradle such that the pads on the first edge of the circuit substrate align with the first side of the carrier cradle and the pads on the second edge of the circuit substrate align with the second side of the circuit substrate, whereby when the adapter is interposed between the connector and the device under test the circuits electrically connect the device under test to the connector.

18 Claims, 5 Drawing Sheets

CONNECTOR TERMINATION ADAPTER

BACKGROUND OF THE INVENTION

Designers of test and measurement devices face a variety of challenges in creating cables and connectors that form probes for interfacing with a device under test (DUT). It is known to integrate networks, such as R, RC, and RCR networks into the cable (just prior to the connector) to perform such functions as compensation, termination and pin redirection. Such networks, should be non-intrusive on the measurement process and in the case of compensation networks should render the entire probe non-intrusive. It is quite difficult to integrate these networks in a completely non-intrusive manner and most known probes have some stub (or non-compensated) length. Further, many of the more successful designs have a mechanically intrusive shape which interferers with the testing procedure.

In particular, known cables with networks typically have stiff cable ends due to the inclusion of a circuit board upon which the networks are mounted. Such configurations limit the usability of the probe. Further, as the network is positioned in the cable path a sizable stub exists comprising the cable connector and the target connector.

In an ideal world, manufactures would include networks on the device under test. However, this is an unrealistic condition for test and measurement designers to impose upon their customers. Not only is the design generally outside the expertise of most customers, it adds cost to the device, something no supplier desires. Another solution is to require the connector manufacturers to design networks into the connector itself. For many of the same reasons, this is unlikely to happen.

The Inventors of the present invention have determined a need for networks that can be easily integrated with standard connectors minimizing stub length while maximizing usability of the probe.

BRIEF DESCRIPTION OF THE DRAWINGS

An understanding of the present invention can be gained from the following detailed description of the invention, taken in conjunction with the accompanying drawings of which.

DETAILED DESCRIPTION

Figure 1:
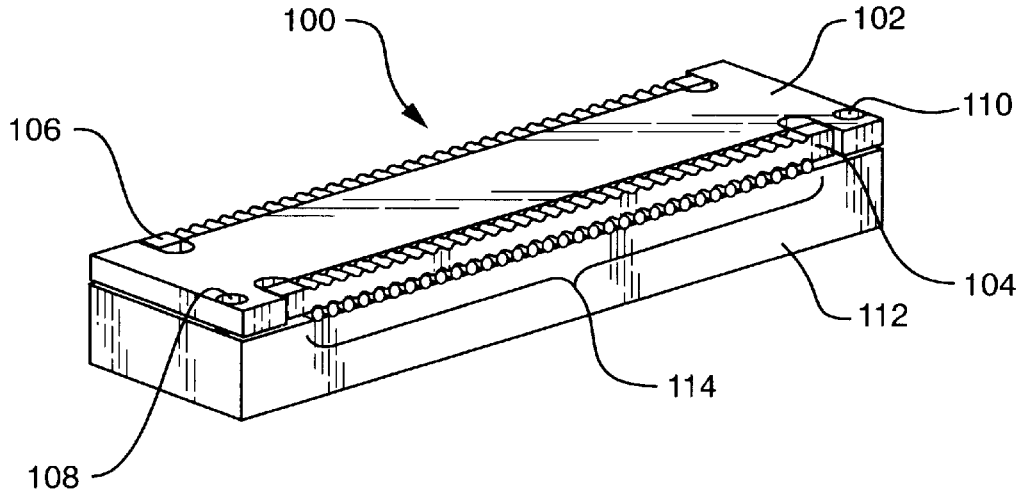
FIG. 1 is an orthogonal view of a connector adapter attached to a connector in accordance with a preferred embodiment of the present invention.

Reference will now be made in detail to the present invention, examples of which are illustrated in the accompanying drawings, wherein like reference numerals refer to like elements throughout.

FIG. 1 is an orthogonal view of a connector adapter 100 ("adapter 100") attached to a connector 112 in accordance with a preferred embodiment of the present invention. It will be appreciated by those of ordinary skill in the relevant arts that the adapter 100, as illustrated in FIG. 1, is generally representative of such adapters and that any particular adapter may differ significantly from that shown in FIG. 1, particularly in the details of construction. As such, the adapter 100 is to be regarded as illustrative and exemplary and not limiting as regards the invention described herein or the claims attached hereto.

The connector 112, as illustrated, typifies a SAMTEC ASP-65067-01 connector. This specific connector is utilized by test and measurement devices marketed by AGILENT TECHNOLOGIES, INC., assignee of the present application. Those of ordinary skill in the art will recognize that many other connectors exist and that the present invention can be suitably modified to interface with most such connectors. The connector 112 provides a series of pads 114 adapted to interface with pads on a device under test. The adapter 100 is soldered to the connector 112 and, as such, is interposed between the connector 110 and the device under test. Generally, the adapter 100 comprises a carrier cradle 102 upon which two circuit substrates 104 and 106 are mounted. The circuit substrates 104 and 106 have circuits formed thereon enabling the creation of, for example, compensation or termination networks. The carrier cradle 102 is aligned with the connector 112 using two holes 108 and 110 that mate with posts (not shown) on the connector 112.

To preserve the functionality of the connector 112, the adapter 100 replicates the pads 114 while interposing a network of circuits (not shown) formed on the sides of the circuit substrates 104 and 106. As is known to those of ordinary skill in the art a variety of circuits can be integrated into the circuit substrates 104 and 106, including resistors, capacitors, inductors, and short circuits. Preferably, pads are formed on opposite sides of the circuit substrates 104 and 106 that interface with the connections 114 on the connector 112 and the connections on the device under test (not shown). The present invention practically eliminates stub length while only having a minimal impact on the usability of the probe as a whole.

Figure 2:
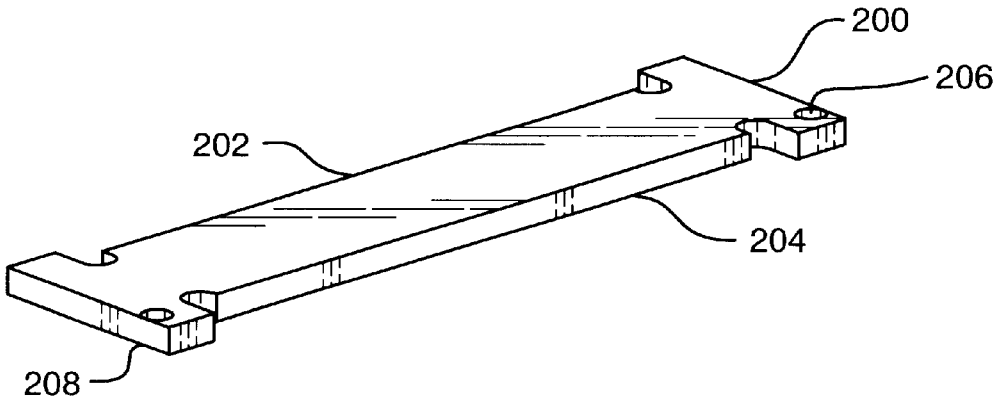
FIG. 2 is an orthogonal view of a carrier cradle in accordance with a preferred embodiment of the present invention.

FIG. 2 is an orthogonal view of a carrier cradle 200 in accordance with a preferred embodiment of the present invention. The carrier cradle 200 is basically "I" shaped with two elongated recess 202 and 204 for receiving circuit substrates (not shown). Two alignment holes 206 and 208 are provided to mate with alignment pins on a connector (not shown). In this case, the alignment holes 206 and 208 are arranged to mate with pins on a SAMTEC ASP-65067-01 connector. In accordance with a preferred embodiment of the present invention, the carrier cradle 200 is preferably 0.040 inches thick, 0.295 inches wide, and 1.231 inches long. Those of ordinary skill in the art will recognize that these dimensions are suggested dimensions suitable for use with an adapter designed to mate with a SAMTEC ASP-65067-01 connector.

Figure 3:
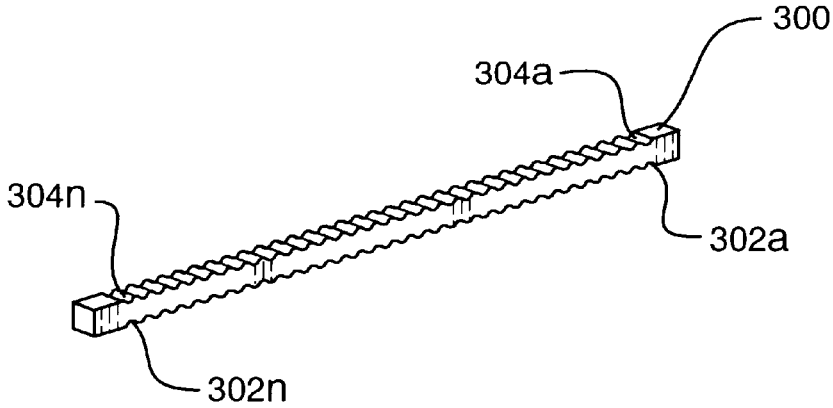
FIG. 3 is an orthogonal view of a circuit substrate in accordance with a preferred embodiment of the present invention.

FIG. 3 is an orthogonal view of a circuit substrate 300 in accordance with a preferred embodiment of the present invention. The circuit substrate 300 is preferably made of an aluminum substrate. Notches 302*a* through 302*n* and 304*a* through 304*n* are formed on either side of the circuit substrate 300. As used herein the letters appended to reference numerals are representative of a specific instance of a structure associated with the element number, with a "n" used to refer to a generic instance of the element or the series of elements as a whole. As noted hereinbelow, conductive pads are formed in the notches 302*n* and 304*n*. Accordingly, the notches 302*n* and 304*n* must have a pitch equivalent to the pads on the connector to which the circuit substrate 300 will be mated. In the case of a SAMTEC ASP-65067-01 connector, a 0.0197 pitch is suitable. The circuit substrate 300 is preferably 1.057" long, 0.040" wide and 0.030" thick.

One method for the formation of the circuit substrates 300 is to form a plurality of appropriately spaced rows of plated through-holes on a substrate. A saw or laser can be used to then cut through the centerline of the plated through holes forming strips that can be used as a circuit substrate 300. As will be shown later, the notches so formed may be filled with solder to create a re-flow pad for surface mounting of both edges.

Figure 4A:
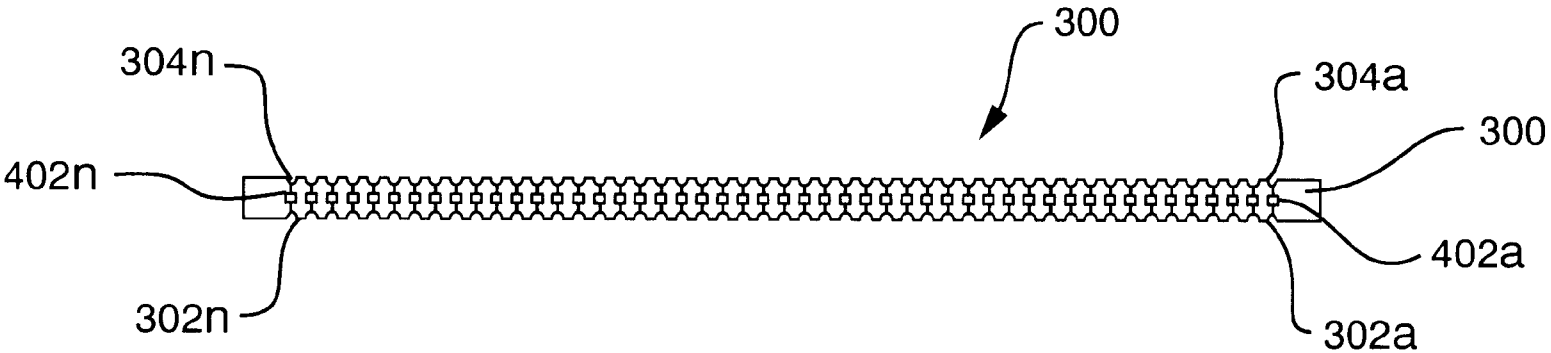
FIG. 4*a* is a side view of a circuit substrate in accordance with a preferred embodiment of the present invention.

FIG. 4*a* is a side view of a circuit substrate 300 in accordance with a preferred embodiment of the present invention. FIG. 4*a* illustrates a network of circuits 402*a* through 402*n* (such as an RCR network) on one side of the circuit substrate 300. To create the network of circuits 402*a* through 402*n* the alumina circuit substrate 300 is inked with traces, resistors, and capacitors. The Ink determines the value and the exact value is a function of trimming the final circuit actively to the precise R and C values. This process is known those in the chips and micro-circuitry in industry. Each circuit 402*n* connects a notch 302*n* to a notch 304*n*.

Figure 4B:
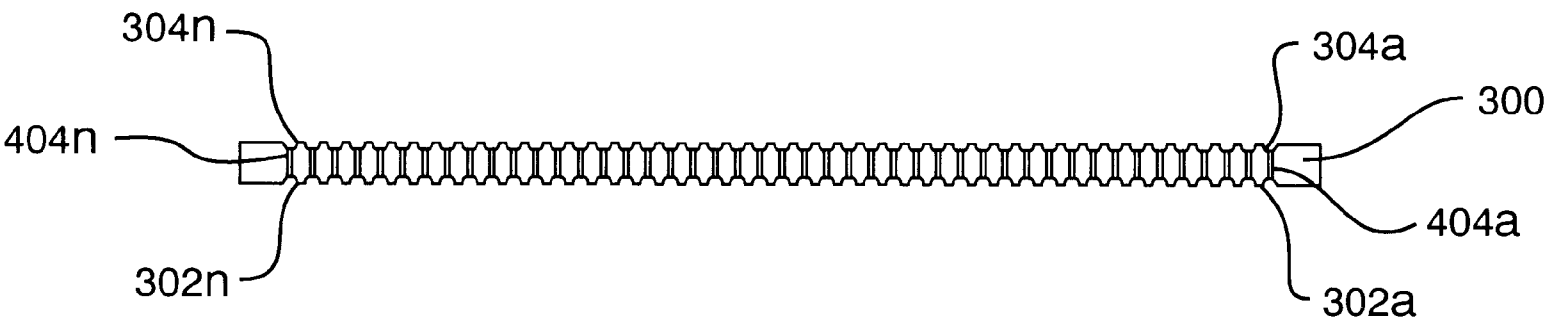
FIG. 4*b* is a side view of a circuit substrate in accordance with a preferred embodiment of the present invention.

FIG. 4*b* is a side view of a circuit substrate 300 in accordance with a preferred embodiment of the present invention. FIG. 4*b* illustrates a series of straight through busses 404*a* through 404*n* inked on one side of the circuit substrate 300. In one preferred embodiment one side of the circuit substrate 300 is inked with circuits 402*n* while the opposite side is inked with straight through busses 404*n*. In connections where a circuit 402*n* is needed, the straight through bus 404*n* on the opposite side of the circuit substrate 300 will be severed, for example by a laser. Conversely, where a straight through bus 404*n* is needed, the circuit 402*n* on the opposite side of the circuit substrate 300 will be severed, also for example by a laser.

In another embodiment, the necessary circuits 402*n* and straight through busses 404*n* are individually inked on a single side of the circuit substrate 300. The opposite side of the circuit substrate 300 will be left blank. Thus, certain notches 302*n* and 304*n* will be connected with circuits 402*n* while the remaining notches 302*n* and 304*n* will be connected with straight through busses 404*n* or left as an open circuit. This configuration will increase the complexity of the engraving steps but eliminate the step of cutting the unused circuits 402*n* and straight through busses 404*n*.

Figure 5B:
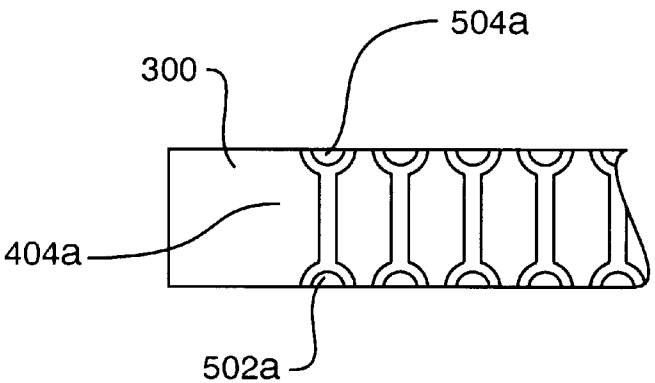
FIG. 5*b* is partial close-up of the side view shown in FIG. 4*b*.
Figure 5A:
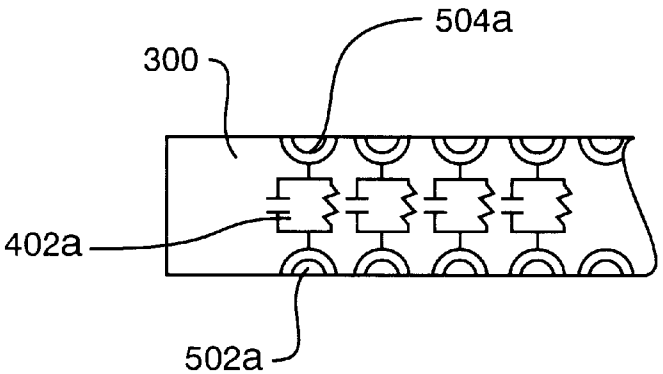
FIG. 5*a* is partial close-up of the side view shown in FIG. 4*a*.

FIG. 5*a* is partial close-up of the side view shown in FIG. 4*a*. In this view the circuits 402*n* are symbolically shown as RCR networks. Solder pads 502*n* and 504*n* are shown filling the notches 302*n* and 304*n*, respectively. FIG. 5*b* is partial close-up of the side view shown in FIG. 4*b*. In this view the straight through busses 404*n* can be clearly seen.

Figure 6:
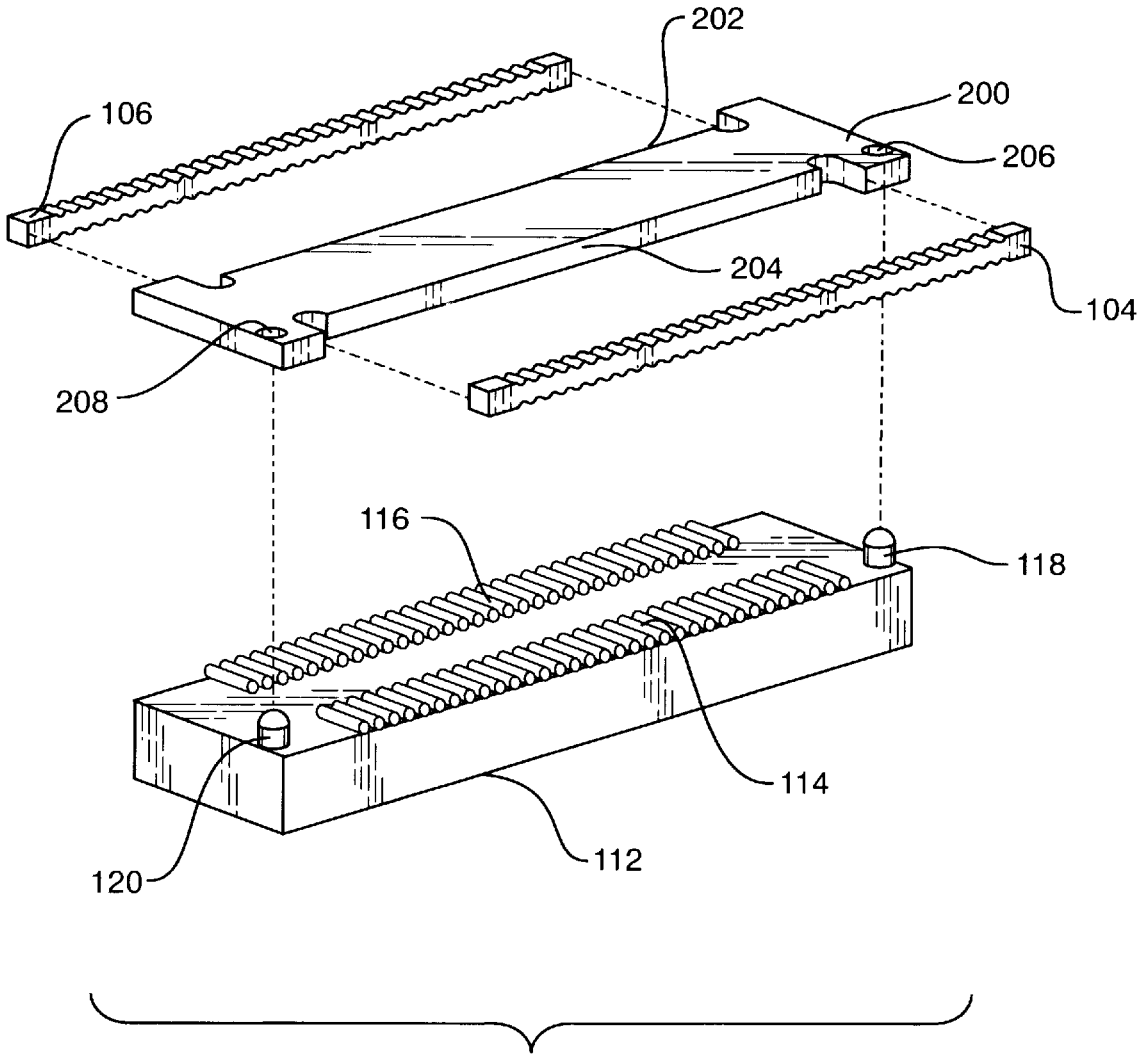
FIG. 6 is an orthogonal assembly view of a connector adapter and a connector in accordance with a preferred embodiment of the present invention.

FIG. 6 is an orthogonal assembly view of a connector adapter and a connector in accordance with a preferred embodiment of the present invention. The circuit substrates 104 and 106 are laminated to the circuit substrate 200 to form the adapter 100. The adapter 100 is then attached, using the re-flow pads to the adapter 112. Alignment is maintained by the interaction of the holes 206 and 208 on the adapter 100 with the posts 118 and 120 on the connector 112.

Although one embodiment of the present invention has been shown and described, it will be appreciated by those skilled in the art that changes may be made in these embodiments without departing from the principles and spirit of the invention, the scope of which is defined in the claims and their equivalents.

What is claimed is:

1. An adapter for attaching a connector having a plurality of pads to a device under test, the adapter comprising:

a carrier cradle wherein opposite major first and second sides have a shape substantially matching the shape of the end of the connector, the carrier cradle being adapted to receive at least one circuit substrate along at least one edge of the first and second sides;

a circuit substrate having plurality of pads formed on a first and second edge, the circuit substrate having a plurality of circuits formed on a first side, each circuit connecting a pad on the first edge of the circuit substrate to a pad on the second edge of the circuit substrate, the circuit substrate being supported by the carrier cradle such that the pads on the first edge of the circuit substrate align with the first major side of the carrier cradle and the pads on the second edge of the circuit substrate align with the second major side of the carrier cradle, whereby when the adapter is interposed between the connector and the device under test the circuits electrically connect the device under test to the connector across the thickness of the carrier cradle.

2. The adapter, as set forth in claim 1, wherein at least one of the plurality of circuits is a short circuit.

3. The adapter, as set forth in claim 1, wherein at least one of the plurality of the circuits comprises a resistor.

4. The adapter, as set forth in claim 1, wherein at least one of the plurality of the circuits comprises a capacitor.

5. The adapter, as set forth in claim 1, wherein at least one of the plurality of the circuits comprises an inductor.

6. The adapter, as set forth in claim 1, wherein at least one of the plurality of the circuits comprises an RC network.

7. The adapter, as set forth in claim 1, wherein at least one of the plurality of the circuits comprises an RCR network.

8. The adapter, as set forth in claim 1, wherein the adapter has a thickness that Is less than 0.06 inches.

9. The adapter, as set forth in claim 1, wherein the carrier cradle is planar with a thickness substantially less than the length or width of the first and second major sides.

10. The adapter, as set forth in claim 1, wherein the plurality of circuits are inked between the first and and second edge of the circuit substrate.

11. The adapter, as set forth in claim 1, wherein the circuit substrate has a plurality of slots formed on the first and second edge of the circuit substrate, each of the plurality of slots being filled with solder to form a plurality of connection pads.

12. The adapter, as set forth in claim 11, wherein the pattern of the plurality of connection pads matches a pattern of pads on a SAMTEC connector.

13. An adapter for attaching a connector having a plurality of pads to a device under test, the adapter comprising:

a carrier cradle having a first side and a second side, the carrier cradle being adapted to receive at least one circuit substrate;

a circuit substrate having plurality of pads formed on a first and second edge, the circuit substrate has a plurality of RCR networks on a first side and a plurality of straight through busses on a second side, each RCR network and straight through bus connecting a pad on the first edge of the circuit substrate to a pad on the second edge of the circuit substrate, wherein each of the RCR networks is paired with a straight through bus and wherein some of the straight through busses have been severed, the circuit substrate being supported by the carrier cradle such that the pads on the first edge of the circuit substrate align with the first side of the carrier cradle and the pads on the second edge of the circuit substrate align with the second side of the circuit substrate, whereby when the adapter is interposed between the connector and the device under test the circuits electrically connect the device under test to the connector.

14. A probe comprising:

a connector having a plurality of pads for interfacing with a device under test;

a carrier cradle aligned with the connector, the carrier cradle having a first side facing the connector and a second side opposite the connector, the carrier cradle being adapted to receive at least one circuit substrate along an edge thereof;

a circuit substrate having a plurality of circuits formed thereon, each circuit electrically connecting a pad on a first edge of the circuit substrate to a pad on a second edge of the circuit substrate, the circuit substrate being supported by the carrier cradle such that the pads along the first edge of the circuit substrate are aligned parallel to the plane of the first side of the cradle and interface with the plurality of pads on the connector and the pads along the second edge of the circuit substrate are aligned parallel to the plane of the second side of the cradle, whereby the circuit electrically connects the device under test to the connector via the pads on the first and second edges of the circuit substrate across the thickness of the carrier cradle.

15. An adapter for attaching a connector to a device under test, the adapter comprising:

a carrier cradle having a length and a width corresponding to a length and width of the connector and a thickness less than 0.10 inches;

a circuit substrate supported by the carrier cradle, the circuit substrate replicating connections on the connector and interposing a plurality of electrical components for interfacing the connector and the device under test, the plurality of electrical circuits being aligned parallel to the thickness of the cradle such that the overall thickness of the adapter is not substantially more than the thickness of the carrier cradle.

16. A method of fabricating an adapter for attaching a connector having a plurality of pads for interfacing with a device under test, the method comprising:

forming a carrier cradle having a length and a width corresponding to a length and width of the connector and a thickness less than 0.10 inches;

forming a circuit substrate having a length corresponding to a length of a series of connection pads on the connector and a width corresponding to a thickness of the carrier cradle;

forming a plurality of pairs of pads on opposite edges of the circuit substrate;

forming a plurality of circuits across the width of the circuit substrate, connecting the plurality of pairs of pads; and attaching the circuit substrate to the cradle such that the pairs of pads are positioned for interfacing the connector and the device under test.

17. An adapter for attaching a connector having a plurality of pads to a device under test, the adapter comprising:

a carrier cradle having a first side and a second side, the carrier cradle being adapted to receive at least one circuit substrate;

a circuit substrate having plurality of pads formed on a first and second edge, the circuit substrate has a plurality of circuits on a first side and a plurality of straight through busses on a second side, each circuit and straight through bus connecting a pad on the first edge of the circuit substrate to a pad on the second edge of the circuit substrate, wherein each of the circuits Is paired with a straight through bus and wherein some of the straight through busses have been severed, the circuit substrate being supported by the carrier cradle such that the pads on the first edge of the circuit substrate align with the first side of the carrier cradle and the pads on the second edge of the circuit substrate align with the second side of the carrier cradle, whereby when the adapter is interposed between the connector and the device under test the circuits electrically connect the device under test to the connector.

18. An adapter for attaching a connector to a device under test, the adapter comprising:

a planer carrier cradle having a length and a width corresponding to a length and width of the connector, the thickness of the carrier cradle being less than 0.1 inches;

a thin elongated circuit substrate supported by the carrier cradle, the circuit substrate replicating connections on the connector and interposing a plurality of electrical components for interfacing the connector and the device under test, the plurality of electrical components being inked across a width of the circuit substrate and oriented across with the thickness of the carrier cradle.

* * * * *